United States Patent [19]

Kikuchi et al.

[11] 3,980,808

[45] Sept. 14, 1976

[54] ELECTRIC CABLE

[75] Inventors: Koji Kikuchi; Hiroshi Suzuki; Toshio Nomura, all of Yokohama, Japan

[73] Assignee: The Furukawa Electric Co., Ltd., Tokyo, Japan

[22] Filed: Sept. 19, 1974

[21] Appl. No.: 507,394

[52] U.S. Cl. ..... 174/110 SR; 174/70 R; 174/102 E; 174/108; 174/131 A

[51] Int. Cl.[2] ..... H01B 7/02; H01B 7/18

[58] Field of Search ..... 174/70 R, 108, 130, 174/131 R, 131 A, 131 B, 128 R, 128 BL, 126 R, 102 R, 107, 120 R, 120 SR, 120 SC, 121 R, 122 G, 124 G, 124 GC; 57/139, 149, 153

[56] References Cited

UNITED STATES PATENTS

| | | | |
|---|---|---|---|
| 3,546,014 | 12/1970 | Nicodemus | 174/120 SR X |
| 3,634,607 | 1/1972 | Coleman | 174/108 X |
| 3,663,742 | 5/1972 | Hasebe et al. | 174/120 SC |
| 3,717,720 | 2/1973 | Snellman | 174/131 A |

FOREIGN PATENTS OR APPLICATIONS

| | | | |
|---|---|---|---|
| 838,494 | 6/1960 | United Kingdom | 174/131 A |
| 1,153,070 | 5/1969 | United Kingdom | 174/131 A |

*Primary Examiner*—Arthur T. Grimley
*Attorney, Agent, or Firm*—Woodling, Krost, Granger & Rust

[57] ABSTRACT

An electric cable comprising a reinforcing member including a roving of strands of reinforcing elongated fibers and synthetic resin having the weight of 15 to 50 percent as against that of the strands and bonding the strands of the roving. The reinforcing member may be in the form of an armoring member, a tensioning member and an insulation.

7 Claims, 11 Drawing Figures

ELECTRIC CABLE

FIELD OF THE INVENTION

This invention pertains to an electric cable including a power cable and a communication cable, and more particularly to an improvement in an electric cable having a fiber reinforced plastic reinforcing member (FRP reinforcing member) applied for imparting various mechanical strengths thereto.

Background of the Invention

An electric cable has a reinforcing member used for the purpose of imparting mechanical strength thereto. The reinforcing member has been provided by armoring an electric cable core, by longitudinally extending along with it or by insulating and reinforcing it. In a typical armored cable, for example, the armoring member comprises a wire or strip member of metal material such as steel, copper alloy, stainless steel and aluminum alloy, and a high tensile strength steel wire used as piano wire. One of the greatest disadvantages of the prior art is that because metal materials have large specific gravities, the metallic reinforcing member becomes very heavy if it is to meet the requirement of high physical stength, and especially high tensile strength. Such heavy reinforcing member increases the weight of the entire electric cable and makes it inconvenient to carry and install the cable. Furthermore, the increased weight of the cable, when laid on the sea bottom, limits the depth of its installation as it requires a high pulling tension. Since a strip type reinforcing member used for an oil-filled or gas filled cable is limited in thickness in view of its physical properties and its manufacture, the electric cable with such reinforcing member cannot possess the larger tensile strength.

Another disadvantage of the prior art is that the metal reinforcing member is inferior in its creeping and corrosion resistances required for the electric cable. The low creeping resistance of the reinforcing member gives rise to extension of the reinforcing member under high tension applied to the electric cable. Such extension of the reinforcing member, which is larger than that of the cable core or sheath, causes trouble such as giving damage to the cable insulation or sheath in the contact area between the reinforcing member and the body of the electric cable. The metal reinforcing member used for a submarine cable conventionally has a coating layer of corrosion resisting material such as plastisol to protect it from chemical or electrical corrosion. During or after installation of the submarine cable, the corrosion resisting layer of the reinforcing member tends to strike against an obstacle such as a rock in the sea and therefore to come off the reinforcing member so that it becomes thin due to its electrical corrosion until it breaks off.

Another disadvantage of the prior metal reinforcing member is that in a power cable it causes armor loss due to current through the power cable and that in a communications cable having the reinforcing member of magnetic material tends to produce noise therefrom. The armor loss reduces the current carrying capacity of the power cable and the noise causes improper operation of terminal apparatuses connected to the communications cable at the receiving ends thereof. Thus, such armor loss and noise should be desirably avoided.

Further disadvantage of the prior metal reinforcing member is that the reinforcing member, which is used for armoring an electric cable tends to bring about kinking of the electric cable. More particularly, the submarine cable tends to be looped due to twisting of the armoring member with which the cable is provided. Thus, when the cable is picked up from the sea bottom for repair, kinking occurs in the cable due to the tension applied resulting in its damage.

Hitherto, in order to eliminate the disadvantages of the prior metal reinforcing member it has been tried to employ fiber reinforced plastics as a reinforcing member for an electric cable. However, due to the bending weakness of the fiber reinforced plastics (FRP) and to difficulty in producing long span of FRP wire, the electric cable with the fiber reinforced plastic wire has been practically not used. We find out that the bending strength of fiber reinforced plastics decreases as the tensile strength increases and therefore, both strengths cannot be satisfied. Another disadvantage of the fiber reinforced plastic member is that the wear resistance of the fiber reinforced plastic reinforcing member is lower than that of the metal reinforcing member. Such lower wear resistance of the reinforcing member, if it is used as the cable armor, causes it to wear when the cable is rubbed on an obstacle such as a rock or sands in the sea due to its swaying by an ocean current or a wave. Therefore, the cable at the wearing portion tends to be damaged.

Object of the Invention

Accordingly, it is a principal object of the present invention to provide an electric cable having a fiber reinforced plastic reinforcing member having the light weight and adapted to be conveniently handled or installed.

It is another object of the present invention to provide an electric cable having a fiber reinforced plastic reinforcing member which is superior in its bending strength as well as its tensile strength.

It is further object of the present invention to provide an electric cable having a fiber reinforced plastic reinforcing member which is superior in its wear resistance as well as its corrosion resistance and kinking resistance and has small creep elongation.

It is another object of the present invention to provide a method for manufacturing an electric cable having a fiber reinforced plastic reinforcing member having the above-mentioned mechanical strengths.

SUMMARY OF THE INVENTION

In accordance with one aspect of the present invention, there is provided an electric cable comprising a fiber reinforced plastic reinforcing member including a roving of strands of elongated fibers and synthetic resin having the weight of 15 to 50 percent as against that of said strands and bonding said strands of said roving. The electric cable includes a power cable and a communication cable involving a coaxial cable. The reinforcing member may armor the electric cable and may longitudinally extend along with the electric cable as a tensioning member. Also it may serve as an insulation. Furthermore, it may extend through the inner conductor of the coaxial cable.

The elongated fibers include inorganic fibers such as glassfibers, carbonfibers and stainless steel fibers, thermoplastic fibers of organic material such as highly oriented polyolefin, polyamide, polyester and polycarbonate, and composite of inorganic and organic fibers. Bonding synthetic resin includes thermosetting resin such as unsaturated polyester, epoxy resin, phenol resin, silicone resin, melamine resin and diacryl-phthalate resin and thermoplastic resin such as polyolefin, polyamide, polystyrene, polycarbonate, styrene-acrylnitril resin and acryl resin. Bonding synthetic resin may have glass powder of at most 16 percent by weight added thereto.

The reinforcing member, which is used as an armoring member or a tensioning member, may have high tensile strength steel wire used as a piano wire contained therein. The reinforcing member, which is used as an armoring member, may be covered at the surface with wear resisting thermoplastic resin. The elongated strand may be a twisted thread or yarn.

In accordance with another aspect of the present invention, there is provided a method for manufacturing an electric cable comprising a fiber reinforced plastic reinforcing member, said method comprising the steps of preparing a roving of strands of elongated fibers, impregnating said roving with thermosetting bonding synthetic resin of 15 to 50 percent by weight as against that of said strands, semi-curing said bonding synthetic resin so as to form a prepreg-roving, mounting said prepreg-roving as said reinforcing member on said electric cable, and thereafter fully curing said thermosetting synthetic resin. The electric cable manufactured in accordance with the above method also includes a power cable and a communication cable. The elongated fibers are preferably inorganic fibers, but may include organic fibers and composite of inorganic and organic fibers.

BRIEF DESCRIPTION OF THE DRAWINGS

The above and other objects and features of the present invention will be apparent from the teaching of the detailed description of the preferred embodiments of the present invention taken with reference to the accompanying drawings wherein.

DETAILED DESCRIPTION OF THE PREFERRED EMBODIMENTS

Figure 1:
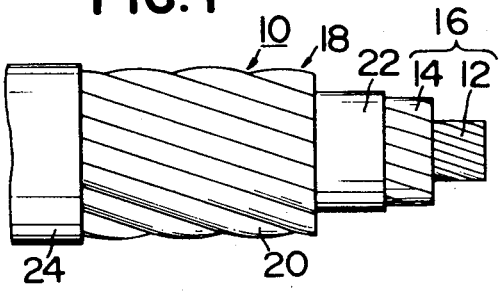
FIG. 1 is a fragmentary side view of a fiber reinforced plastics armored electric cable with the component layers partially exposed.

Referring now to FIG. 1, there is shown a typical embodiment of an electric cable 10 having a fiber reinforced plastic reinforcing member embodying the present invention. The term "fiber reinforced plastics" is referred to as FRP hereinafter. It should be noted that the term "reinforcing member" is referred to as a single reinforcing wire or a collective member of reinforcing wires. The electric cable 10 comprises a cable core 16 having a cable conductor 12 and an insulation 14 covered around the cable conductor 12. While the electric cable may be a communication cable, in the illustrated embodiment it is in the form of a power cable. Although the cable conductor 12 is illustrated to be collectively a single element in FIG. 2, it practically comprises a twisted conductor of a plurality of wires. The insulation 14 is conventionally provided by extruding thermoplastic material on the conductor or otherwise. The FRP reinforcing member 18 comprises a plurality of elongated FRP wires 20, the construction and composition of which will be described in detail later with reference to FIGS. 4 to 7. The FRP reinforcing member 18 may be in the form of an armoring member for armoring the cable core 16. The cable core 16 may be covered with an inner sheath 22 within the FRP reinforcing member 18 while the latter is covered with an outer sheath 24. The inner sheath 22 may be conventionally formed of plastics such as polyvinyl chloride extruded on the cable core, but alternately of metal material such as lead. The outer sheath 24, in the illustrated embodiment, may comprise wear resisting and thermoplastic synthetic resin extruded on the FRP reinforcing member 18 so as to improve the wear and deteriorative resistances of the FRP reinforcing member 18. Although the FRP reinforcing member 18 has high tensile strength and light weight as described later in detail, it is inferior in wear resistance and alkali-proofness. The wear resisting outer sheath 24 avoids the problems caused by the inferior resistances and therefore, the electric cable can be installed in the sea without deteriorating the properties of the reinforcing member 18 even in a contaminated area. Material suitable for the outer sheath 24 is highly polymerized polyethylene or polyamide. The most preferable material is polyethylene having the molecular weight of more than two hundred thousands. Preferably, the outer sheath material may have a sulfide trapping agent added thereto, which comprises metal or metal salt to provide a stable metal oxide when the agent contacts with sulfide. The electric cable with the outer sheath of such trapping agent containing material, when installed in the sea, can avoid the occurence of tree thereon which is caused by the intrusion of sulfide.

Figure 2:
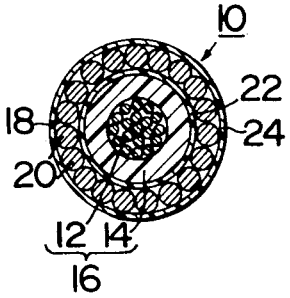
FIG. 2 is a cross sectional view of the electric cable of FIG. 1.
Figure 3:
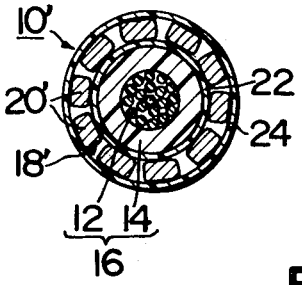
FIG. 3 is substantially identical to FIG. 2, but illustrating the electric cable having the reinforcing wires of different cross section.

The electric cable 10′ of FIG. 3 is substantially identical to the electric cable of FIGS. 1 and 2, except that it has the elongated FRP wires 20′ of elliptical cross section rather than circular one. Of course, the wire 20 and 20′ may be of other cross section such as rectangular, and polygonal cross section. It will be seen from FIG. 1 that the elongated wires 20 extend along with the cable core 16 and spirally therearound in a given pitch. It will be understood that the wires 20′ of FIG. 3 are arranged in a similar manner.

Figure 4:
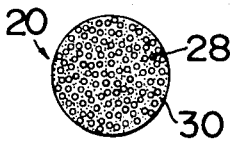
FIG.4 is an enlarged cross sectional view of one of the reinforcing wires employed for the present invention.

As seen from FIG. 4, each of the FRP wires 20 comprises a roving 28 of strands each having a plurality of elongated fibers and synthetic resin 30 impregnated in the roving to bond the strands of the roving. The elongated fibers of the strands may be of inorganic material such as glass, carbon and stainless steel. Glassfiber is suitable and specially nonalkaline glassfiber is most suitable because it is superior in physical strength, waterproofness and alkaline resistance. The elongated fiber may also be of thermoplastic organic material such as highly oriented polyolefin, polyamide, polyester and polycarbonate. Of course, the strands may comprise composite of inorganic and organic fibers. Bonding synthetic resin 30 includes thermosetting resin such as unsaturated polyester, epoxy resin, phenol resin, silicone resin, melamine resin and diacrylphthalate resin and thermoplastic resin such as polyolefin, polyamide, polystyrene, polycarbonate, styrene-acrylnitrile resin and acrylic resin.

Referring to a method for manufacturing the FRP wire 20, strands of elongated fibers are collectively bundled and impregnated with thermosetting resin as bonding resin. Next, the resin is set for bonding the strands. Where thermoplastic resin is used to bond the strands, they are impregnated with resin melted by heat, or alternatively, they are impregnated and covered with such resin by extruding it on the bundled strands. Such impregnated strands are finally cooled and solidified. The amount of the bonding resin 30 used for impregnation of the roving 26 is equivalent to 15 to 50 percent by weight as against 85 to 50 percent by weight of fibers and most preferably to 20 to 40 percent by weight as against 80 to 60 percent by weight of fibers. Generally, as the content of reinforcing fibers is increased, the FRP roving tends to gain in tensile strength, but lose in bending strength. The tendency is remarkable in case the reinforcing fibers are inorganic. The resin, when used in an amount of less than 15 percent, causes the bending strength of the reinforcing member to decrease abruptly and, when used in an amount of more than 50 percent, causes the tensile strength to decrease considerably. The kinds and combinations of the reinforcing fibers and bonding resin are properly selected corresponding to the properties required of the product for which they are used.

Figure 7:
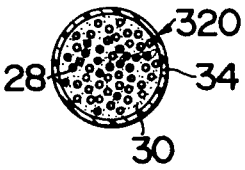
FIG. 7 is a cross sectional view of further modification of the reinforcing wire employed for the present invention.

The following Table I compares the properties of the FRP wire of circular cross section shown in FIG. 7, comprising 65 percent by weight of glassfibers and 35 percent by weight of unsaturated polyester and FRP wire of square cross section comprising 73 percent by weight of glassfibers and 27 percent by weight of polyester.

Table I

| Properties | Wire | | |
|---|---|---|---|
| | FRP wire of circular cross section | FRP wire of square cross section | Iron wire |
| Specific gravity | 1.82 | 2.16 | 7.87 |
| Bending strength (kg/mm²) | 105 | 85 – 95 | — |
| Coefficient of bending elasticity (kg/mm²) | $3.6 \times 10^3$ | $2.5 \times 10^3$ | $2.0 \times 10^4$ |
| Tensile strength (kg/mm²) | 70 – 130 | 60 – 80 | 30 – 55 |
| Compressive strength (kg/mm²) | 45.4 | 30 – 43 | — |
| Water content | 0.2 | 0.1 | — |

Table I-continued

| Properties | Wire | | |
|---|---|---|---|
| | FRP wire of circular cross section | FRP wire of square cross section | Iron wire |
| 96 hrs. (%) | | | |

As seen from the above Table I, the FRP wires are considerably lower in specific gravity and higher in tensile strength than the iron wire. The FRP wires are practical because the bending strength ranges from 85 to 105 kg/mm².

Table II shows a comparison of the weight of the electric cable armored with the FRP wires of circular cross section shown in Table I and that of the electric cable armored with the iron wire also shown in the Table I, both of which have the same finished dimension. The electric cables are substantially identical to those shown in FIGS. 1 and 2, except that they have no outer sheath.

Table II

| Cables | 6kv 3 × 22mm² 9 × 2mm² cross-linked polyethylene cable | | 275kv 1 × 1200mm² oil-filled cable | |
|---|---|---|---|---|
| Armoring Member | Iron wires | FRP wires | Iron wires | FRP wires |
| Weight of cable core (kg/m) | 4.6 | 4.6 | 40.2 | 40.2 |
| Weight of armoring member (kg/m) | 5.5 | 1.3 | 10.2 | 2.4 |
| Total weight (kg/m) | 10.1 | 5.9 | 50.4 | 42.6 |
| Radius of cable core (mm) | 43.9 | 43.9 | 103.5 | 103.5 |
| Radius of armoring wire (mm) | 6 | 4.5 | 6 | 4.5 |
| Number of armoring wire | 19 | 35 | 55 | 87 |

As seen from Table II, the FRP wire armored cable weighs considerably less than the iron wire armored cable.

Table III below shows the current carrying capacities of the iron wire armored and the FRP wire armored cables, both of which are of 275KV and 1 × 1200mm² as shown in the right column of Table II. In these cables, the diameter of one of the conductors of the cable is 44.7mm, the diameter of the insulation 89.7mm and the diameter of the armored or finished cable 103.1mm.

Table III

| Armoring member | FRP armoring wires 4.5mm diameter | Iron armoring wires 6mm diameter |
|---|---|---|
| Thermal resistance of insulation (th-Ω/cm) | 59 | 59 |
| Thermal resistance of armoring member (th-Ω/cm) | 11.3 | — |
| Thermal resistance of soil (th-Ω/cm) | 40 | 40 |

Table III-continued

| Armoring member | FRP armoring wires 4.5mm diameter | Iron armoring wires 6mm diameter |
|---|---|---|
| Armor loss relative to conductor loss | 0 | 2.65 |
| Current (A) | 1540 | 1140 |

As apparent from Table III, the FRP wire armored cable of the present invention has a higher thermal resistance, but no armor loss, thereby increasing transmission current by about 25 percent. Thus, the power cable of the present invention can have a higher current carrying capacity.

The following Table IV shows some examples of the FRP wire of the present invention wherein the compositions of the roving and bonding synthetic resin and the properties of the finished wires are listed.

Table IV

| Roving | Bonding synthetic resin | Content of roving (%) | Tensile strength (kg/mm²) | Coefficient of bending elasticity (kg/mm²) |
|---|---|---|---|---|
| Glassfiber roving | Epoxy resin | 70 | 136 | $0.61 \times 10^3$ |
| Boron fiber roving | Epoxy resin | 70 | 196 | $2.94 \times 10^3$ |
| Glassfiber roving | Phenol resin | 50 | 45 | $0.35 \times 10^3$ |
| Carbon fiber roving | Polyester | 50 | 120 | less than $10 \times 10^3$ |

Figure 5:
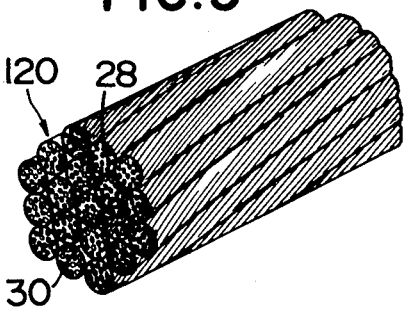
FIG. 5 is a fragmentary enlarged perspective view of the modification of the roving constituting the reinforcing wire.

An elongated FRP wire 120 of FIG. 5 has respective strands of the roving 28 twisted about their own axes. The roving 28 is preferably the bundle of such twisted threads. As previously described, as the FRP wire increases in the content of the fibers so as to increase its tensile strength, its bending strength decreases, while as it decreases in the content of the fibers so as to provide an increased bending strength thereto, its tensile strength decreases. It should be noted that such twisted strands provide an increased flexibility to the FRP wire, resulting in improvement in permissible bending radius. By way of example, the FRP wire, which comprises 80 percent by weight of glassfibers and 20 percent by weight of polyester with the strands twisted, has the tensile strength of 80 Kg/mm² and the bending strength of 90 Kg/mm², while the FRP wire, which comprises 85 percent by weight of glassfibers and 15 percent by weight of unsaturated polyester, has the tensile strength of 108 Kg/mm² and the bending strength of 75 Kg/mm².

The elongated FRP wires 20 and 120 of FIGS. 4 and 5 may each have glassfiber powder added thereto so as to further improve their bending strength. Glassfiber powder may be preferably added in approximately 16 percent by weight relative to that of bonding synthetic resin in the FRP wire. If glass powder exceeds 16 percent by weight, then tensile strength of the wire becomes abruptly decreased and therefore, it should not exceed the value. Table V shows the physical strength of the FRP wire having the strands of untwisted glassfibers, 76 percent by weight, and bonding unsaturated polyester, 19 percent by weight, with 20 to 30 $\mu$ glassfiber powder, 5 percent by weight, with which the strands are impregnated, the FRP wire having the strands of glassfibers, 81 percent by weight and unsaturated polyester, 19 percent by weight with which the strands are impregnated, and the steel wire.

Table V

| Wire | Mechanical strength: Tensile strength (kg/mm²) | Bending strength (kg/mm²) | Coefficient of bending elasticity (kg/mm²) |
|---|---|---|---|
| FRP wire with glass powder added | 101.7 | 98.0 | $3.9 \times 10^3$ |
| FRP wire without glass powder | 128.0 | 77.2 | $5.2 \times 10^3$ |
| Steel wire | 30 – 55 | — | — |

As seen from the Table V, the FRP wires with glass powder added have an increasingly improved bending strength and therefore, when they are used to armor the electric cable as shown in FIGS. 1 to 3, they can be twisted around it in a smaller pitch. Thus, the electric cable has an improved flexibility which facilitates its installation and elongates its life. The improved flexibility of the FRP wire permits the electric cable to be wound in a relatively small diameter and therefore in a larger length on a reel, thereby making it possible to manufacture electric cables of continuous length.

Figure 6:
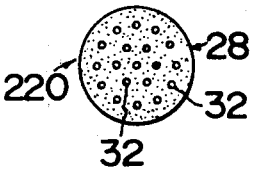
FIG. 6 is a cross sectional view of another modification of the reinforcing wire employed for the present invention.

An elongated FRP wire 220 of FIG. 6 is substantially identical to the FRP wire 20 of FIG. 4, but has high tensile strength steel wires 32 contained in the FRP roving 28 of the fiber strands. The electric cable with such FRP wires used thereon is suitable especially for submarine cable or vertical shaft laying cable because it has both the light weight of FRP and the high tensile strength of the piano wire. Piano wires contribute to prevention of FRP snapping.

An elongated FRP wire 320 of FIG. 7 is also substantially identical to the FRP wire 20 of FIG. 4, but is covered at the periphery thereof with a synthetic resin layer 34 of material identical to that of the wear resisting outer sheath 24 of FIG. 2. This layer 34 can be applied either by extrusion method or by immersion method. Of course, it will be understood that the body of the FRP wire of FIG. 7 can be replaced by that of the FRP wire of FIG. 6. By using the FRP wire 320 of FIG. 7 for armoring the electric cable 10 as shown in FIGS. 1 and 2, the outer sheath 24 of these figures may be formed of nonwear resisting material.

It will be understood that the electric cable 10' of FIG. 3 having the elliptical cross section may have the same composition and construction as those of the elongated FRP wires of FIGS. 4 to 7.

Figure 8:
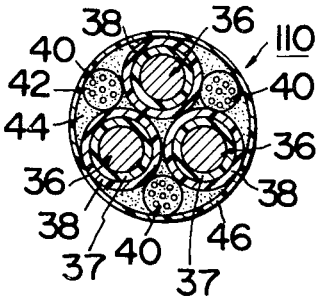
FIG. 8 is a cross sectional view of a triplex type electric cable embodying the present invention.

Referring now to FIG. 8, there is shown an embodiment of a triplex type power cable 110 suitable for installation in an inclined or a vertical manner. The cable 110 comprises three of conductors or cores 36 each having an insulating layer 37 thereon and a sheath 38 of any suitable plastics extruded on the insulation and which are twisted in a given pitch. A reinforcing member 40 comprises elongated FRP wires 42 as a tensioning member disposed between the adjacent cable cores and twisted together with the cable cores in the same pitch as that of the cable cores. In the illustrated embodiment, a pad or jute 44, for example, may be filled between the cable cores and the reinforcing members 40 and a tape 46 of any suitable material such as glass, for example, may be wound around the cable cores and the reinforcing members 40 so as to hold the jute 44 therebetween. Alternatively, a sheath may be provided on the cable cores and the reinforcing member by extruding thermoplastic material thereon. Of course, it will be understood that the FRP wires 42 may be any one of those shown in FIGS. 4 to 7. Since such power cable preferably has the cable cores tightened by the twisted reinforcing member 40 and also since the reinforcing members 40 have higher tensile strength, even though the cable is substantially vertically installed in a hydraulic power station, for example, the cable cores 36 are prevented from slipping off.

In manufacturing the electric cables of FIGS. 1 to 3 and 8, although the reinforcing members may be intertwisted in the form of the finished FRP wires about the cable bodies, it is preferable that they may be intertwisted about the cable bodies during semi-curing of bonding synthetic resin and thereafter the latter may be cured. More particularly, where the bonding synthetic resin is thermosetting resin, the prepreg FRP wires under semi-curing condition may be intertwisted about the cable bodies and then fully cured by heating them. Similarly, where the bonding synthetic resin is thermoplastic resin, the FRP wires during softening by heat of the bonding synthetic resin may be mounted on the cable bodies and thereafter they may be cooled and solidified. Thus, the reinforcing members have no residual stress because it is removed therefrom during semi-curing or softening of the bonding resin, resulting in the electric cables preferably having lower coefficients of bending elasticity to improve their flexibilities.

Figure 9:
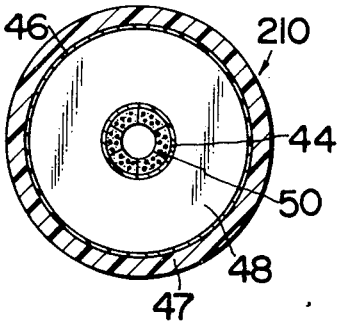
FIG. 9 is a cross sectional view of a coaxial cable embodying the present invention.

Referring now to FIG. 9, there is shown a coaxial cable 210 embodying the present invention, and the coaxial cable comprises a pipe type inner conductor 44 of either copper or aluminum, a pipe type conductor 46 of the same material and dielectric substances 48 between the inner and outer conductors 44 and 46. A reinforcing member 50 may comprise a plurality of elongated FRP wires of segmental cross section, the construction and composition of which may be similar to any of those of the FRP wires of FIGS. 4 to 6.

Figure 10:
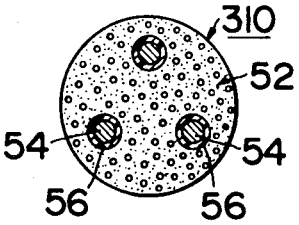
FIG. 10 is a cross sectional view of an electric cable insulated with fiber reinforced plastics in accordance with the present invention.

Referring now to FIG. 10, there is shown an electric cable 310 in which a FRP reinforcing member 52 serves to also act as an insulation. In the illustrated embodiment, the electric cable may be in the form of three core type cable including three conductors 54, but may be in the form of a single core type or other multiple core type cable which may embody the present invention. The insulation and reinforcing member 52 may have the composition and construction substantially identical to those of the FRP wires of FIGS. 4 and 5. Of course, it will be understood that the reinforcing member 52 may have glassfiber powder added thereto in the same ratio as described in connection with FIGS. 4 and 5. If desired, it may be reinforced by a high tensile strength steel wire or wires called "piano wire or wires" as shown in FIG. 6, and may have a covering layer of wear resisting resin provided on the periphery of the FRP reinforcing member as shown in FIG. 7. As shown in FIG. 10, the conductors 54 may be provided with a releasing synthetic resin covering layer 56 on the surface of the conductors. Thus, if the electric cables are desired to be connected either to each other or to another electric wire, the insulation and reinforcing member 52 can be easily removed from the conductors 54. Such release agent may include polytetra-fluorethylene and silicon. The following Table VI compares the electrical properties of FRP insulation, which comprises strands of glassfibers, 65 percent by weight, and unsaturated polyester, 35 percent by weight, and other insulations such as polyvinyl-chloride, polyethylene and butyl rubber.

Table VI

| Insulations | Properties: Dielectric constant | Dielectric loss tangent (%) | Resistivities (cm) | Dielectric breakdown strength (kV/mm) |
|---|---|---|---|---|
| FRP | 3.8 | 0.4 | $10^{15}$ | 20 |
| Polyvinyl chloride | 3.3 – 3.5 | 9.0 – 10 | $10^{14}$ | 12 – 16 |
| Polyethylene | 2.5 – 2.3 | 0.03 | $10^{15}$ | 18 – 24 |
| Butyl rubber | 2.5 – 3.5 | 0.3 – 0.8 | $10^{15}$ | 16 – 25 |

As seen from the above Table, the FRP reinforcing member can be used as an insulation in place of a conventional insulation for a conductor.

The following Table VII shows the mechanical strength of an FRP reinforced single core type electric cable having the FRP insulation of the Table VI and a conventional polyethylene insulated single core type electric cable. Both of these cables are of 6 kV class and have a conductor of cross section area of 22 mm².

Table VII

| Properties | Kind: Polyethylene insulated cable | FRP reinforced and insulated cable |
|---|---|---|
| Tensile strength (kg/mm²) | about 180 | about 2,700 |
| Breaking load (kg) | about 600 | about 12,960 |

It will be seen from the above Table that the FRP insulated and reinforced cable according to the present invention is considerably superior in tensile strength and breaking load to the conventional cable.

Figure 11:
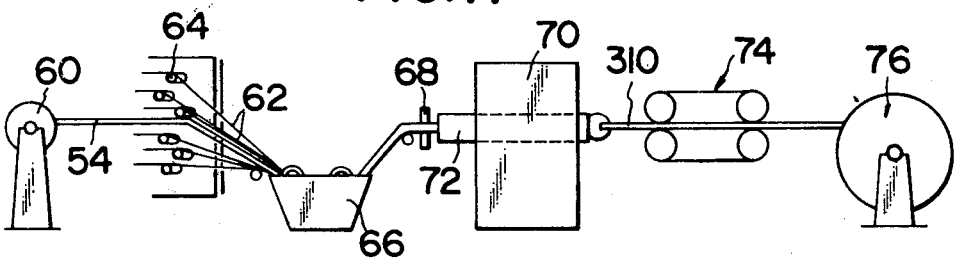
FIG. 11 is a schematic diagram of an apparatus suitable for manufacturing the electric cable of FIG. 4.

FIG. 11 schematically shows a system for manufacturing the electric cable 310 of FIG. 10. One cable conductor 54 which is typical of the three conductors in this figure is drawn out from an uncoiler 60 and during the cable conductor's running, numerous glassfiber strands 62 longitudinally extend and run along together with the cable conductor. The glassfiber strands 62 are guided in a spaced relation to each other by guide rollers 64. The cable conductor 54 and the glassfiber strands 62 therearound then pass through a bonding synthetic resin impregnating tank 66 to impregnate the glassfiber strands 62 with the bonding synthetic resin. Thereafter, the cable conductor 54 and the synthetic resin impregnated glassfiber strands 62 pass through a guide reel 68 to form the components so as to provide a circular cross section thereto. After leaving the guide reel 68, they then pass through a die 72 extending through a heating furnace 70 wherein synthetic resin is solidified while the synthetic resin impregnated glassfiber strands are tightened against the cable conductor. Thus, the electric cable 310 shown in FIG. 10 is completed. The electric cable is wound up by a coiler 76 while it is taken up through a capstan 74. The capstan 74 is for taking up the electric cable at a constant feeding velocity in a conventional manner.

While some preferred embodiments of the present invention have been illustrated and described in connection with the accompanying drawings, it will be apparent from those skilled in the art that they are by way of exemplary illustration and that various changes and modifications might be made without departing from the spirit and scope of the present invention, which has been defined only to the appended claims.

What is claimed is:

1. An electric cable comprising electrical conductor means and a fiber reinforced plastic reinforcing member including a roving of strands of reinforcing elongated fibers and synthetic resin of 15 to 50 percent by weight as compared with said strands, said strands of said roving being bonded by said synthetic resin, characterized in that said synthetic resin has glass powder of at most 16 percent by weight added thereto.

2. An electric cable as set forth in claim 1, wherein said reinforcing member armors the body of said electric cable.

3. An electric cable as set forth in claim 1, said cable being a triplex type cable and wherein said reinforcing member is a tensioning member longitudinally extending along with the body of said triplex type cable.

4. An electric cable as set forth in claim 1, wherein said reinforcing member further comprises at least one high tensile strength steel wire contained therein.

5. An electric cable as set forth in claim 1, wherein said reinforcing member further comprises a wear-resisting thermoplastic synthetic resin layer provided on the periphery of said reinforcing member.

6. An electric cable as set forth in claim 1, wherein said reinforcing member armors the body of said electric cable and further comprising a sheath of wear-resisting material provided on the armored body of said electric cable.

7. An electric cable as set forth in claim 1, said electrical conductor means includes at least one conductor imbedded in said reinforcing member.

* * * * *